US008230935B2

(12) United States Patent
Gano et al.

(10) Patent No.: US 8,230,935 B2
(45) Date of Patent: Jul. 31, 2012

(54) SAND CONTROL SCREEN ASSEMBLY WITH FLOW CONTROL CAPABILITY

(75) Inventors: John C. Gano, Carrollton, TX (US); Luke W. Holderman, Plano, TX (US); Jean Marc Lopez, Plano, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 371 days.

(21) Appl. No.: 12/576,925

(22) Filed: Oct. 9, 2009

(65) Prior Publication Data

US 2011/0083860 A1 Apr. 14, 2011

(51) Int. Cl.
*E21B 34/08* (2006.01)
*E21B 43/08* (2006.01)

(52) U.S. Cl. ..... 166/386; 166/205; 166/233; 166/236; 166/319; 166/373

(58) Field of Classification Search ..... 166/205, 166/319, 227, 233, 236, 326, 373, 386
See application file for complete search history.

(56) References Cited

U.S. PATENT DOCUMENTS

| | | | |
|---|---|---|---|
| 148,387 | A | 3/1874 | Squires |
| 1,536,348 | A | 5/1925 | Mack |
| 2,517,841 | A | 8/1950 | Chenault |
| 2,602,516 | A | 7/1952 | Echols et al. |
| 5,320,178 | A | 6/1994 | Cornette |
| 5,337,808 | A | 8/1994 | Graham |
| 5,435,393 | A | 7/1995 | Brekke et al. |
| 5,803,179 | A | 9/1998 | Echols et al. |
| 5,812,331 | A | 9/1998 | Lopez et al. |
| 5,896,928 | A | 4/1999 | Coon |
| 6,112,815 | A | 9/2000 | Boe et al. |
| 6,112,817 | A | 9/2000 | Voll et al. |
| 6,343,651 | B1 | 2/2002 | Bixenman |
| 6,371,210 | B1 | 4/2002 | Bode et al. |
| 6,470,749 | B1 | 10/2002 | Han et al. |
| 6,622,794 | B2 | 9/2003 | Zisk, Jr. |
| 6,644,412 | B2 | 11/2003 | Bode et al. |
| 6,719,051 | B2 | 4/2004 | Hailey, Jr. et al. |
| 6,786,285 | B2 | 9/2004 | Johnson et al. |

(Continued)

FOREIGN PATENT DOCUMENTS

| | | |
|---|---|---|
| GB | 2421746 | 7/2006 |

(Continued)

OTHER PUBLICATIONS

Martin P. Coronado, Next Generation Sand Screen Enables Drill-in Sandface Completions, Offshore (Dec. 2009), pp. 54-56.

*Primary Examiner* — Giovanna Wright
(74) *Attorney, Agent, or Firm* — Lawrence R. Youst

(57) ABSTRACT

A flow control screen (100) includes a base pipe (102) having a blank pipe section (104) and a perforated section (106). A filter medium (112) is positioned around a portion of the blank pipe section (104). A housing (114, 118, 120, 122, 124) is positioned around another portion of the blank pipe section (104) and the perforated section (106). A deformable element (150) is positioned between the housing and a portion of the perforated section including at least one production port (108) but not including at least one closure port (110) to define a production path (154) between the production port (108) and the filter medium (112) such that application of a sufficient pressure to the closure port (110) acts on the deformable element (150) to deform the deformable element (150) to substantially close the production path (154).

21 Claims, 12 Drawing Sheets

U.S. PATENT DOCUMENTS

| | | | |
|---|---|---|---|
| 6,857,476 | B2 | 2/2005 | Richards |
| 6,883,613 | B2 | 4/2005 | Bode et al. |
| 6,886,634 | B2 | 5/2005 | Richards |
| 6,899,176 | B2 | 5/2005 | Hailey, Jr. et al. |
| 7,055,598 | B2 | 6/2006 | Ross et al. |
| 7,096,945 | B2 | 8/2006 | Richards et al. |
| 7,100,686 | B2 | 9/2006 | Wittrisch |
| 7,185,706 | B2 | 3/2007 | Freyer |
| 7,191,833 | B2 | 3/2007 | Richards |
| 7,204,316 | B2 | 4/2007 | Dusterhoft et al. |
| 7,413,022 | B2 | 8/2008 | Broome et al. |
| 7,537,056 | B2 | 5/2009 | MacDougall |
| 2007/0012444 | A1 | 1/2007 | Horgan et al. |
| 2007/0039741 | A1 | 2/2007 | Hailey et al. |
| 2007/0246210 | A1 | 10/2007 | Richards |
| 2007/0246213 | A1 | 10/2007 | Hailey, Jr. |
| 2007/0246407 | A1 | 10/2007 | Richards et al. |
| 2008/0035330 | A1 | 2/2008 | Richards |
| 2008/0041580 | A1 | 2/2008 | Freyer et al. |
| 2008/0041581 | A1 | 2/2008 | Richards |
| 2008/0041588 | A1 | 2/2008 | Richards et al. |
| 2008/0283238 | A1 | 11/2008 | Richards et al. |
| 2008/0314590 | A1 | 12/2008 | Patel |
| 2009/0000787 | A1 | 1/2009 | Hill et al. |
| 2009/0084556 | A1 | 4/2009 | Richards et al. |
| 2009/0133869 | A1 | 5/2009 | Clem |
| 2009/0133874 | A1 | 5/2009 | Dale et al. |
| 2009/0133875 | A1 | 5/2009 | Tibbles et al. |
| 2009/0133882 | A1 | 5/2009 | Delaloye et al. |
| 2009/0151925 | A1 | 6/2009 | Richards et al. |
| 2009/0277650 | A1 | 11/2009 | Casciaro et al. |
| 2011/0198097 | A1 | 8/2011 | Moen |

FOREIGN PATENT DOCUMENTS

| | | |
|---|---|---|
| GB | 2455001 | 5/2009 |
| WO | 02075110 | 9/2002 |
| WO | 2004018837 | 3/2004 |
| WO | 2009048822 | 4/2009 |
| WO | 2009048823 | 4/2009 |
| WO | 2009065793 | 4/2009 |
| WO | 2009065890 | 5/2009 |
| WO | 2009066097 | 5/2009 |
| WO | 2009067021 | 5/2009 |

SAND CONTROL SCREEN ASSEMBLY WITH FLOW CONTROL CAPABILITY

TECHNICAL FIELD OF THE INVENTION

This invention relates, in general, to controlling the production of fluids and particulate materials from a well that traverses a hydrocarbon bearing subterranean formation and, in particular, to a flow control screen that is operable to control the inflow of formation fluids.

BACKGROUND OF THE INVENTION

Without limiting the scope of the present invention, its background will be described with reference to producing fluid from a hydrocarbon bearing subterranean formation, as an example.

During the completion of a well that traverses a hydrocarbon bearing subterranean formation, production tubing and various completion equipment are installed in the well to enable safe and efficient production of the formation fluids. For example, to prevent the production of particulate material from an unconsolidated or loosely consolidated subterranean formation, certain completions include one or more sand control screens positioned proximate the desired production intervals. In other completions, to control the flow rate of production fluids into the production tubing, it is common practice to install one or more flow control devices within the tubing string.

Attempts have been made to utilize fluid flow control devices within completions requiring sand control. For example, in certain sand control screens, after production fluids flows through the filter medium, the fluids are directed into a flow control section. The flow control section may include one or more flow restrictors such as flow tubes, nozzles, labyrinths or the like. Typically, the production rate through these sand control screens is fixed prior to installation by individually adjusting the flow restrictors of the sand control screens.

It has been found, however, that the during the completion process, it may be desirable to pressure up the completion string to operate or set certain tools, such as packers. Current flow control screens require the running of a separate work string into the completion string to achieve this result or require that one or more permanent check valves be incorporated into each flow control screen which increases the cost and complexity of such screens and reduces the reliability of such screens. In addition, it has been found, that it may desirable to temporarily or permanently shut off production at certain locations in a completion interval. To achieve this result, current flow control screens incorporate sliding side doors, which add complexity to each screen and require mechanical intervention to operate the flow control screens between open and closed positions.

Accordingly, a need has arisen for a flow control screen that is operable to control the inflow of formation fluids in a completion requiring sand control. A need has also arisen for such a flow control screen that is operable to be pressured up during the completion process. Further, a need has arisen for such a flow control screen that is operable to temporarily or permanently shut off production therethrough.

SUMMARY OF THE INVENTION

The present invention disclosed herein comprises a flow control screen for controlling the inflow of formation fluids in completions requiring sand control. The flow control screen of the present invention is operable to be pressured up during the completion process. In addition, the flow control screen of the present invention is operable to temporarily or permanently shut off production therethrough.

In one aspect, the present invention is directed to a flow control screen that includes a base pipe having a blank pipe section and a perforated section including at least one production port and at least one closure port. A filter medium is positioned around a first portion of the blank pipe section of the base pipe. A housing is positioned around a second portion of the blank pipe section of the base pipe and the perforated section of the base pipe. A deformable element is positioned between the housing and a portion of the perforated section including the at least one production port but not including the at least one closure port to define a production path between the at least one production port and the filter medium such that application of a sufficient pressure to the at least one closure port acts on the deformable element to deform the deformable element to substantially close the production path.

In one embodiment, the deformable element may be a pressure deformable element. In another embodiment, the deformable element may be a closure sleeve including an annular closure sleeve. In a further embodiment, the deformable element may be one or more expandable tubes. In this embodiment, a moveable piston may be disposed within the expandable tubes to aid in the deformation process. In yet another embodiment, the deformable element may be an expandable annular unit.

In certain embodiments, the deformable element is operable to reopen the production path in response to a sufficient pressure reduction at the at least one closure port. In other embodiments, at least one valve assembly may be disposed within a fluid flow path between the at least one production port and the filter medium. The valve assembly may include a valve body, a valve plug received within the valve body and a retainer pin initially preventing relative movement between the valve body and the valve plug. The valve assembly is operably to be shortened in response to a pressure increase that exceeds a predetermined threshold level and shears the retainer pin allowing shortening of the valve assembly. Thereafter, a pressure decrease will cause the valve assembly to be discharged from the fluid flow path.

In another aspect, the present invention is directed to a flow control apparatus that includes a tubular member having at least one production port and at least one closure port. A housing is positioned around the tubular member. A deformable element is positioned between the housing and a portion of the tubular member including the at least one production port but not including the at least one closure port to define a production path between the deformable element and the base pipe such that application of a sufficient pressure to the at least one closure port acts on the deformable element to deform the deformable element to substantially close the production path.

In a further aspect, the present invention is directed to a method for operating a flow control screen. The method includes providing a deformable element positioned between a housing and a portion of a perforated section of a base pipe including at least one production port but not including at least one closure port to define a production path between the at least one production port and a filter medium, applying a sufficient pressure to the at least one closure port, and responsive to the sufficient pressure, deforming the deformable element to substantially close the production path.

The method may also include, responsive to the sufficient pressure, moving a piston disposed within the deformable element to aid in the deformation of the deformable element and reopening the production path in response to a sufficient pressure reduction at the at least one closure port. In addition, the method may include pressurizing the flow control screen at the at least one production port, holding the pressure within the flow control screen with a valve assembly disposed within a fluid flow path in the flow control screen, increasing the pressure in the flow control screen above a predetermined threshold level to shear a retainer pin of the valve assembly causing a shortening of the valve assembly and continuing to hold pressure within the flow control screen, decreasing the pressure at the at least one production port and responsive to the pressure decease, discharging the valve assembly from the fluid flow path.

BRIEF DESCRIPTION OF THE DRAWINGS

For a more complete understanding of the features and advantages of the present invention, reference is now made to the detailed description of the invention along with the accompanying figures in which corresponding numerals in the different figures refer to corresponding parts and in which.

DETAILED DESCRIPTION OF THE INVENTION

While the making and using of various embodiments of the present invention are discussed in detail below, it should be appreciated that the present invention provides many applicable inventive concepts which can be embodied in a wide variety of specific contexts. The specific embodiments discussed herein are merely illustrative of specific ways to make and use the invention, and do not delimit the scope of the present invention.

Figure 1:
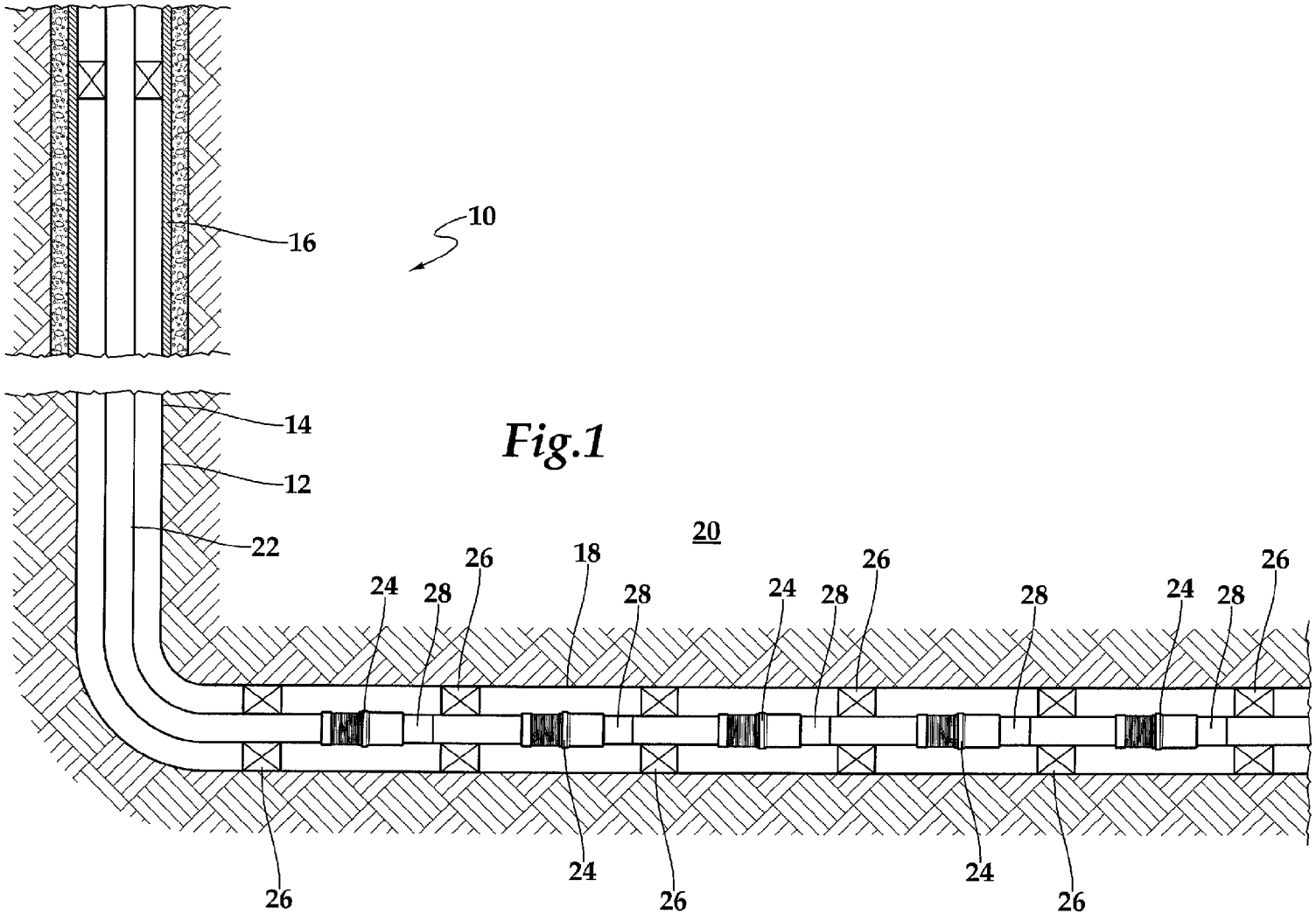
FIG. 1 is a schematic illustration of a well system operating a plurality of flow control screens according to an embodiment of the present invention.

Referring initially to FIG. 1, therein is depicted a well system including a plurality of flow control screens embodying principles of the present invention that is schematically illustrated and generally designated 10. In the illustrated embodiment, a wellbore 12 extends through the various earth strata. Wellbore 12 has a substantially vertical section 14, the upper portion of which has cemented therein a casing string 16. Wellbore also has a substantially horizontal section 18 that extends through a hydrocarbon bearing subterranean formation 20. As illustrated, substantially horizontal section 18 of wellbore 12 is open hole.

Positioned within wellbore 12 and extending from the surface is a tubing string 22. Tubing string 22 provides a conduit for formation fluids to travel from formation 20 to the surface. At its lower end, tubing string 22 is coupled to a completions string that has been installed in wellbore 12 and divides the completion interval into various production intervals adjacent to formation 20. The completion string includes a plurality of flow control screens 24, each of which is positioned between a pair of packers 26 that provides a fluid seal between the completion string 22 and wellbore 12, thereby defining the production intervals. The completion string also includes a plurality of locating nipples 28, each of which is associated with one of the flow control screens 24.

Flow control screens 24 serve the primary functions of filtering particulate matter out of the production fluid stream and controlling the flow rate of the production fluid stream. In addition, as discussed in greater detail below, flow control screens 24 are operable to be pressured up during installation of the completion string. For example, when the completion string is positioned in the desired location in well 12, internal pressure may be used to set packers 26 to divide the completion interval into the desired number of production intervals. During this setting process, flow control screens 24 are in their running configuration in which they are operable to hold pressure for repeated cycles as long as the pressure remains below a predetermined threshold pressure. Once all pressure operated completion components are set or during the setting of the final pressure operated completion component, the internal pressure may be raised above the predetermined threshold pressure to operate flow control screens 24 into their sheared configuration. In this configuration, flow control screens continue to hold pressure, however, when the internal pressure is released and the differential pressure across flow control screens 24 is positive between the outside and inside of flow control screens 24, flow control screens 24 are operated to their production configuration.

Once in this configuration, if it is desired to cease production through one or more of the flow control screens 24, a straddle assembly (not shown) may be used to pressurize a chamber in flow control screens 24 to operate the flow control screens 24 to the shut off configuration. The locating nipple 28 associated with the flow control screen 24 through which production is no longer desired is used to properly positioned the straddle assembly within the flow control screen 24 to perform this pressurizing operation. Once in this configuration, if it is desired to reestablish production through a previously shut off flow control screen 24, the straddle assembly may be used to reduce the pressure or created a vacuum in the chamber to operate the flow control screen 24 back to the production configuration.

Even though FIG. 1 depicts the flow control screens of the present invention in an open hole environment, it should be understood by those skilled in the art that the flow control screens of the present invention are equally well suited for use in cased wells. Also, even though FIG. 1 depicts one flow control screen in each production interval, it should be understood by those skilled in the art that any number of flow control screens of the present invention may be deployed within a production interval without departing from the principles of the present invention. Also, even though FIG. 1 depicts a locating nipple associated with each flow control screen, other configurations of locating nipples and flow control screens and other locating methods are possible and are considered within the scope of the present invention.

In addition, even though FIG. 1 depicts the flow control screens of the present invention in a horizontal section of the wellbore, it should be understood by those skilled in the art that the flow control screens of the present invention are equally well suited for use in deviated wellbores, vertical wellbores, multilateral wellbore and the like. Accordingly, it should be understood by those skilled in the art that the use of directional terms such as above, below, upper, lower, upward, downward, uphole, downhole and the like are used in relation to the illustrative embodiments as they are depicted in the figures, the upward direction being toward the top of the corresponding figure and the downward direction being toward the bottom of the corresponding figure, the uphole direction being toward the surface of the well and the downhole direction being toward the toe of the well.

Figure 2A:
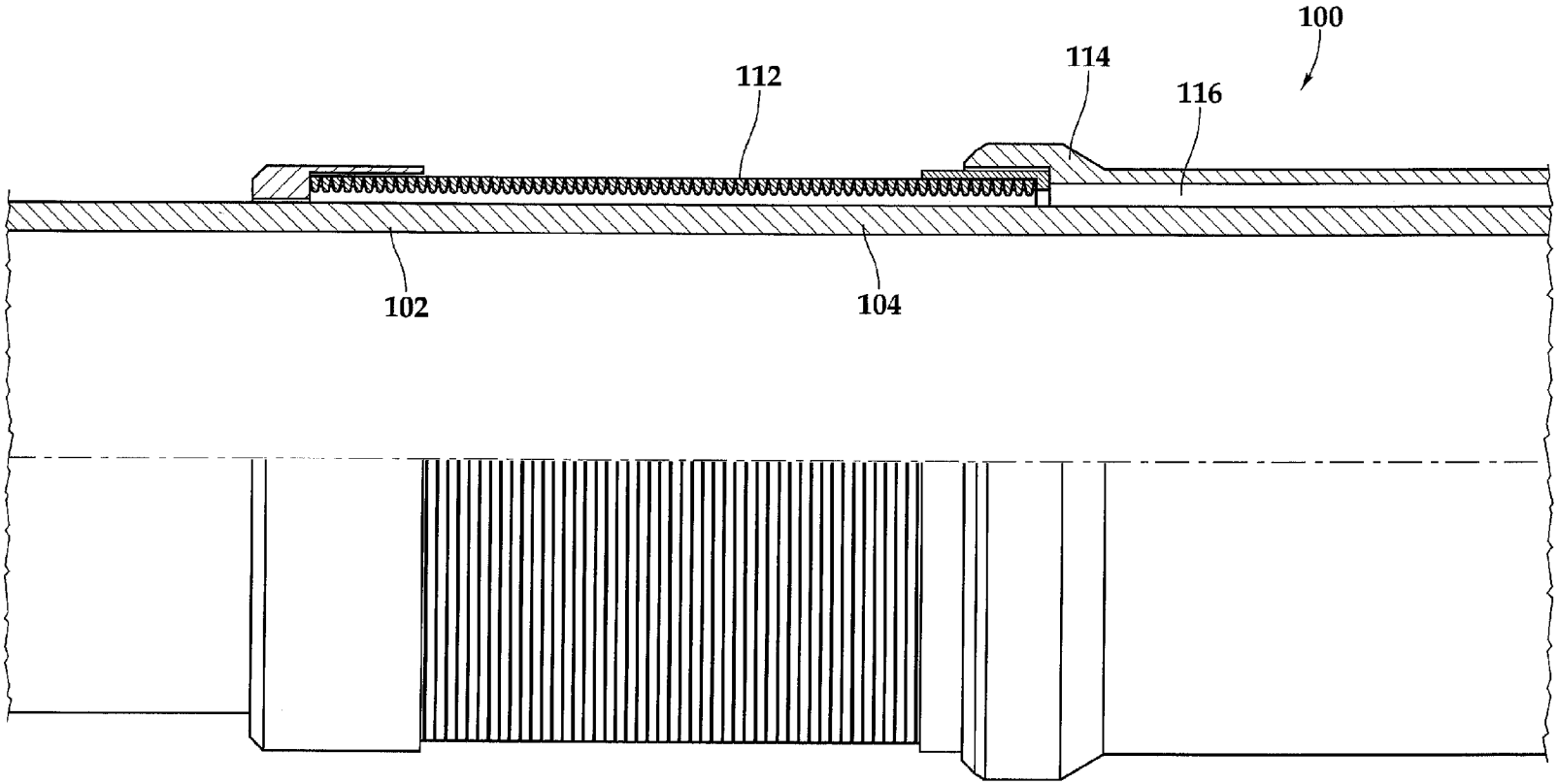
FIGS. 2A-2C are quarter sectional view of successive axial sections of a flow control screen according to an embodiment of the present invention.
Figure 2B:
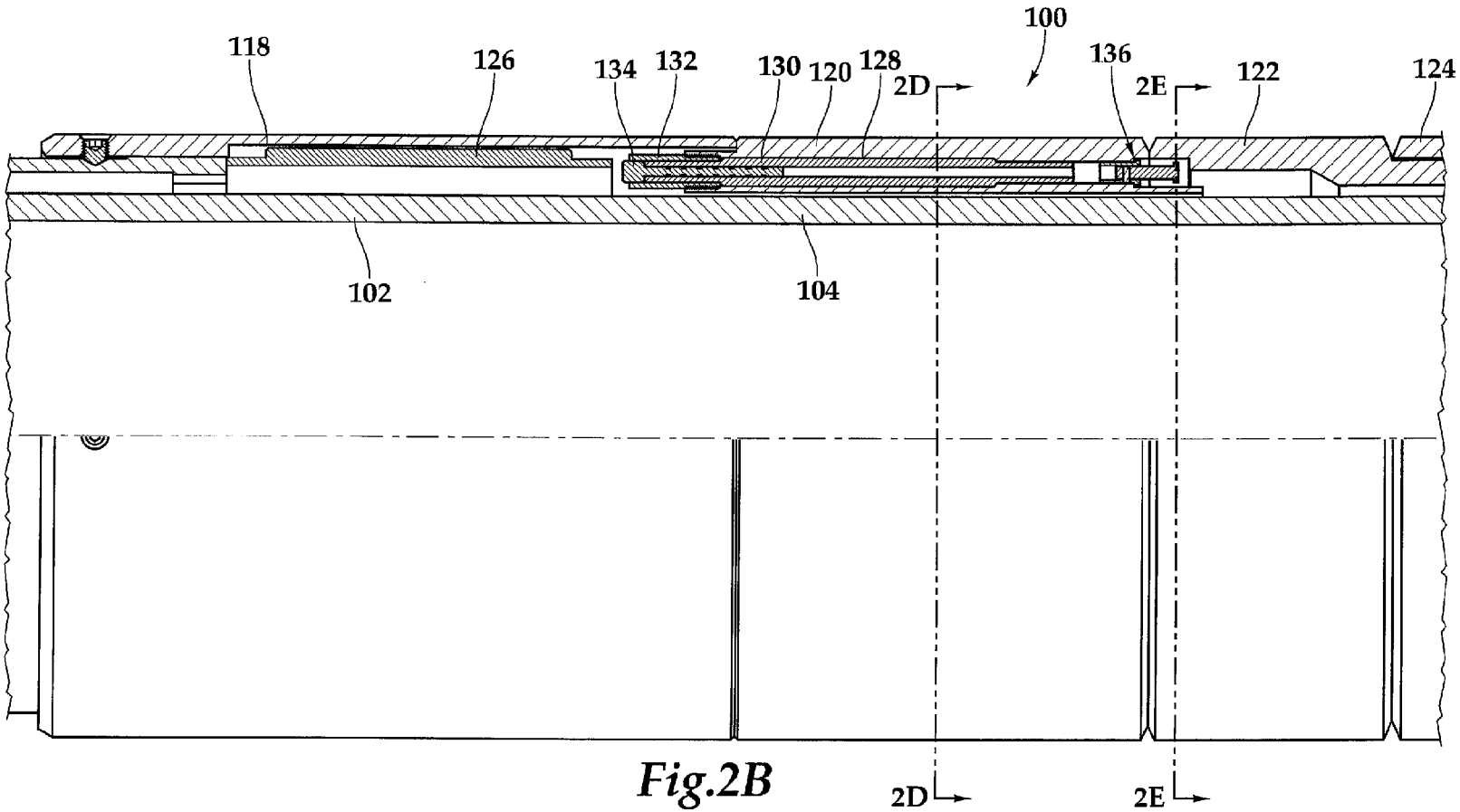
Figure 2C:
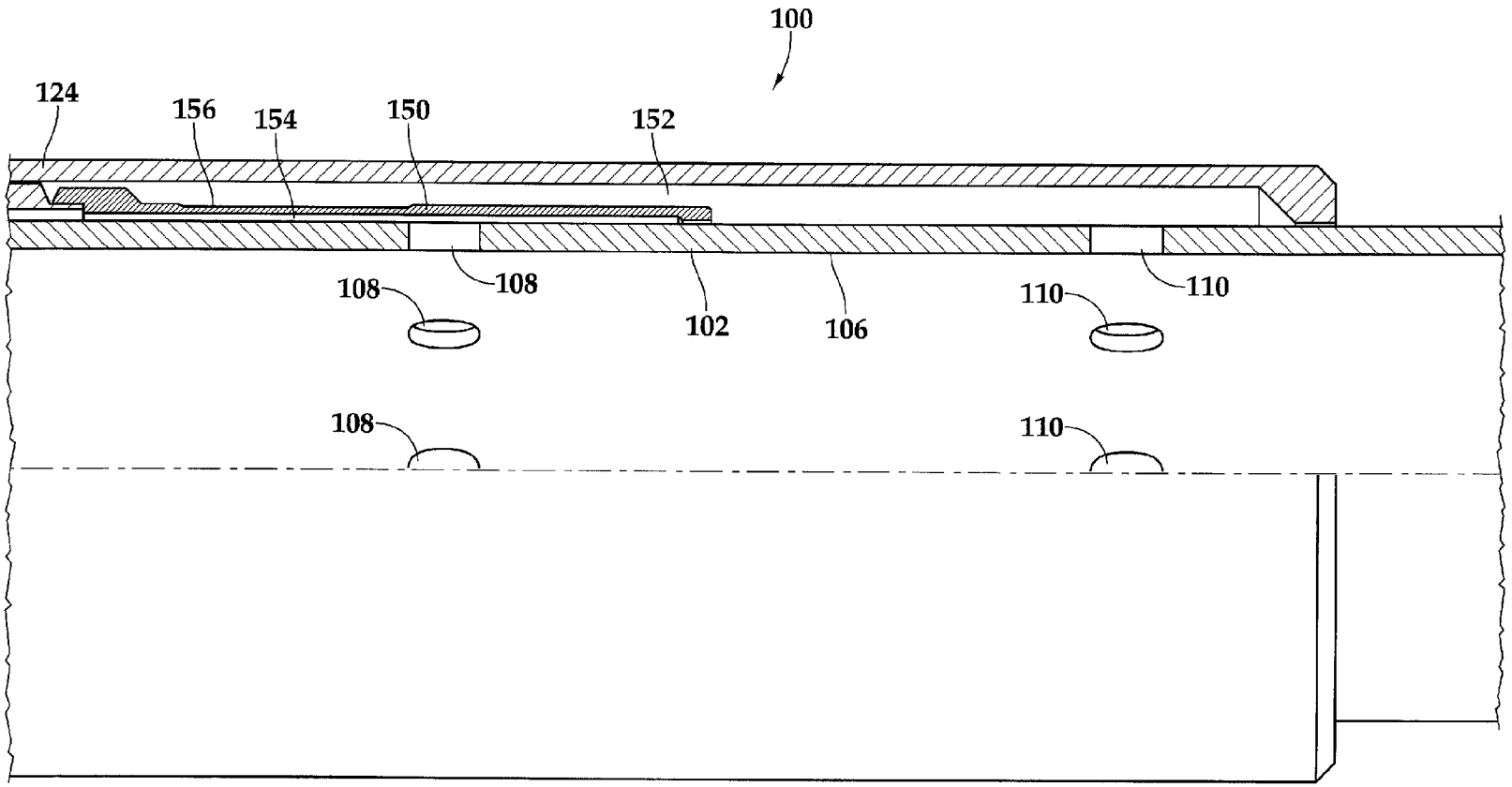

Referring next to FIGS. 2A-2C, therein is depicted successive axial sections of a flow control screen according to the present invention that is representatively illustrated and generally designated 100. Flow control screen 100 may be suitably coupled to other similar flow control screens, production packers, locating nipples, production tubulars or other downhole tools to form a completions string as described above. Flow control screen 100 includes a base pipe 102 that has a blank pipe section 104 and a perforated section 106 including a plurality of production ports 108 and a plurality of closure ports 110. Positioned around an upper portion of blank pipe section 104 is a screen element or filter medium 112, such as a wire wrap screen, a woven wire mesh screen or the like, designed to allow fluids to flow therethrough but prevent particulate matter of a predetermined size from flowing therethrough. Positioned downhole of filter medium 112 is a screen interface housing 114 that forms an annulus 116 with base pipe 102. Securably connected to the downhole end of screen interface housing 114 is a sleeve housing 118. At its downhole end, sleeve housing 118 is securably connected to a flow tube housing 120 which is securably connected to the uphole end of an intermediate housing 122. In addition, flow tube housing 120 is preferably securably connected or sealably coupled to base pipe 102 to prevent fluid flow therebetween. Toward its downhole end, intermediate housing 122 is securably connected to a closure housing 124 which is preferably welded to base pipe 102 at its downhole end. The various connections of the housing sections may be made in any suitable fashion including welding, threading and the like as well as through the use of fasteners such as pins, set screws and the like. Together, the housing sections create a generally annular fluid flow path between filter medium 112 and perforated section 106 of base pipe 102.

Figure 2D:
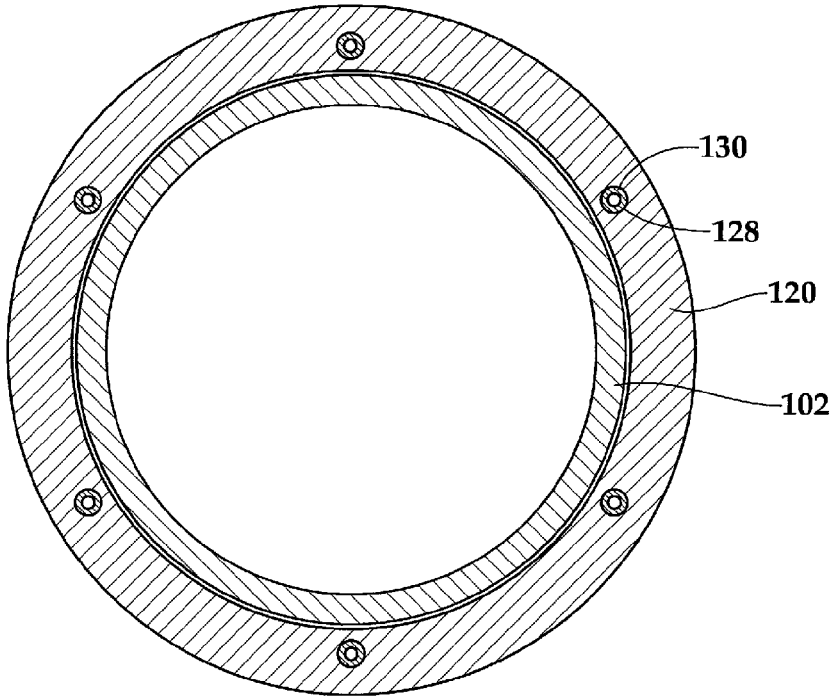
FIGS. 2D-2E are cross sectional views of the flow control screen of FIG. 2B taken along line 2D-2D and 2E-2E, respectively.

Positioned in the annular region between housing sleeve 118 and base pipe 102 is a split ring spacer 126. Positioned within axial openings 128 in flow tube housing 120 is a plurality of flow tubes 130. As best seen in FIG. 2D, the illustrated embodiment includes six axial openings 128 and six flow tubes 130, however, those skilled in the art will recognize that other numbers of flow tubes both greater than and less than six could alternatively be used and would be considered within the scope of the present invention. Each of the flow tubes 130 is secured within flow tube housing 120 by a threaded retaining sleeve 132. One or more of the flow tube 130 may have a threaded cap or a plug 134 associated therewith to inhibit or stop flow therethrough. The use of plugs 134 and flow tubes 130 having various inner diameters allow an operator to adjust the pressure drop rating of each flow control screen 100 to a desired level such that a completion string including a plurality of flow control screens 100 is operable to counteract heel-toe effects in long horizontal completions, balance inflow in highly deviated and fractured wells, reduce annular sand transportation and reduce water/gas influx, thereby lengthening the productive life of the well.

Figure 2E:
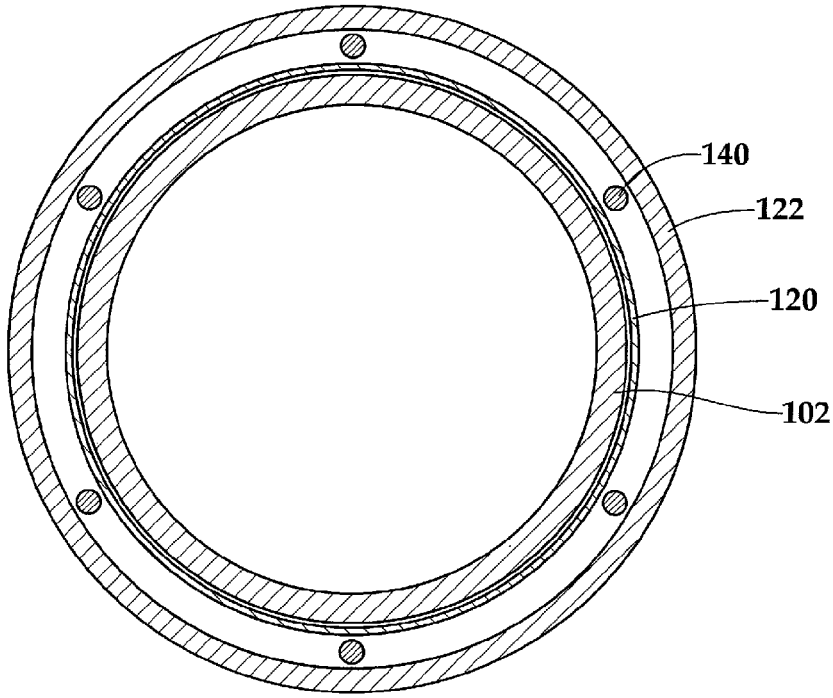
Figure 3A:
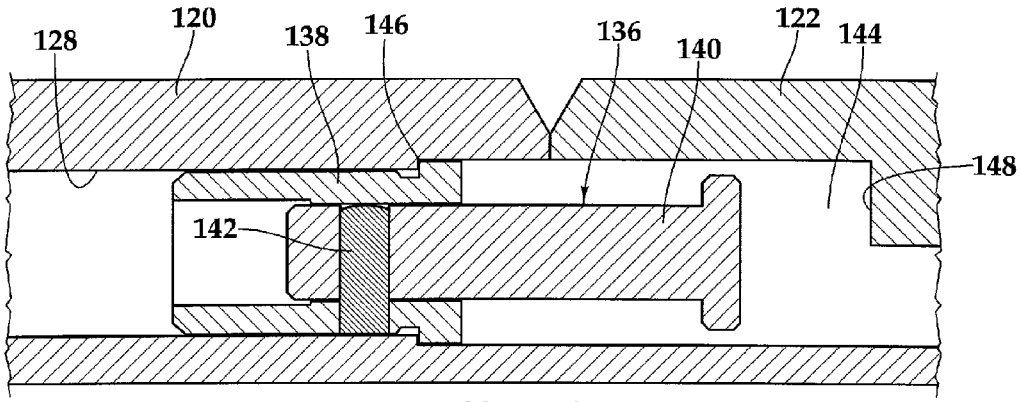
FIGS. 3A-3C are cross sectional views of a valve assembly in its various operating configurations that is operable for use in a flow control screen according to an embodiment of the present invention.
Figure 3B:
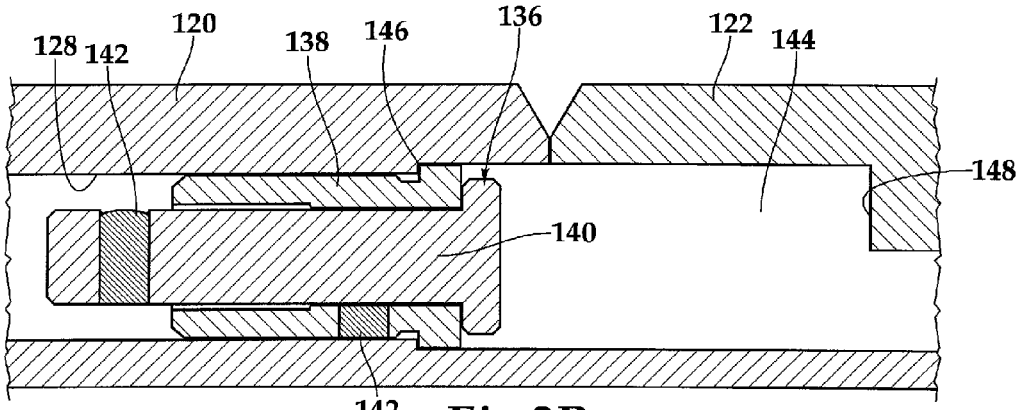
Figure 3C:
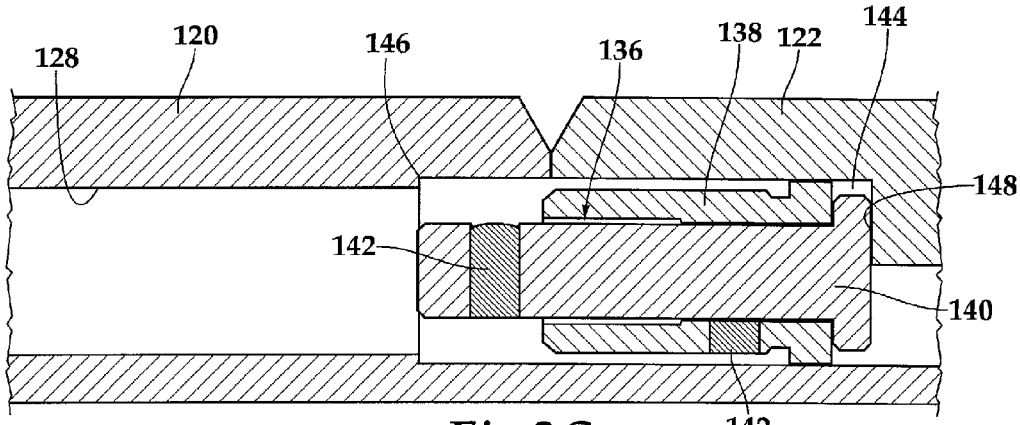

Positioned within the downhole end of each of the axial openings 128 of flow tube housing 120 is a valve assembly 136. As best seen in FIGS. 3A-3C, each valve assembly 136 includes a valve body 138, a valve plug 140 and a retainer pin 142. Valve plugs 140 are initially prevented from moving relative to valve bodies 138 by the associated retainer pins 142, as best seen in FIG. 3A. Each valve body 138 is closely received within one of the axial openings 128 of flow tube housing 120. The downhole ends of valve assemblies 136 are disposed within an annular region 144 that is defined between intermediate housing 122 and flow tube housing 120, as best seen in FIG. 2E. As illustrated, uphole travel of valve assemblies 136 is limited by no go shoulders 146 associated with each axial opening 128 and downhole travel of valve assemblies 136 is limited by annular shoulder 148. FIG. 3A represents the running configuration of flow control screen 100 in which valve assemblies 136 are length captured between no go shoulders 146 and annular shoulder 148. In this configuration, internal pressure may be applied to the tubular string deploying flow control screens 100. Specifically, the internal pressure will travel through production ports 108 but is prevented from passing through flow tubes 130 by valve assemblies 136. Repeated pressure cycles may be applied to the tubular as long as the pressure remains below the shear pressure of retainer pins 142.

When it is desired to operate flow control screens 100 from the running configuration to the sheared configuration, the internal pressure may be raised above the shear pressure of retainer pins 142 causing retainer pins 142 to shear, as best seen in FIG. 3B. In this configuration, valve assemblies 136 continue to hold pressure and prevent fluid flow through flow control screens 100 from production ports 108 to filter medium 112. Once the internal pressure is released and the differential pressure across flow control screens 100 is positive between the outside and inside of flow control screens 100, valve assemblies 136 are expelled from axial openings 128 into annular region 144, as best seen in FIG. 3C. Once expelled, valve assemblies 136 no longer prevent fluid flow through flow tubes 130 which places flow control screens 100 in their production configuration.

Figure 4A:
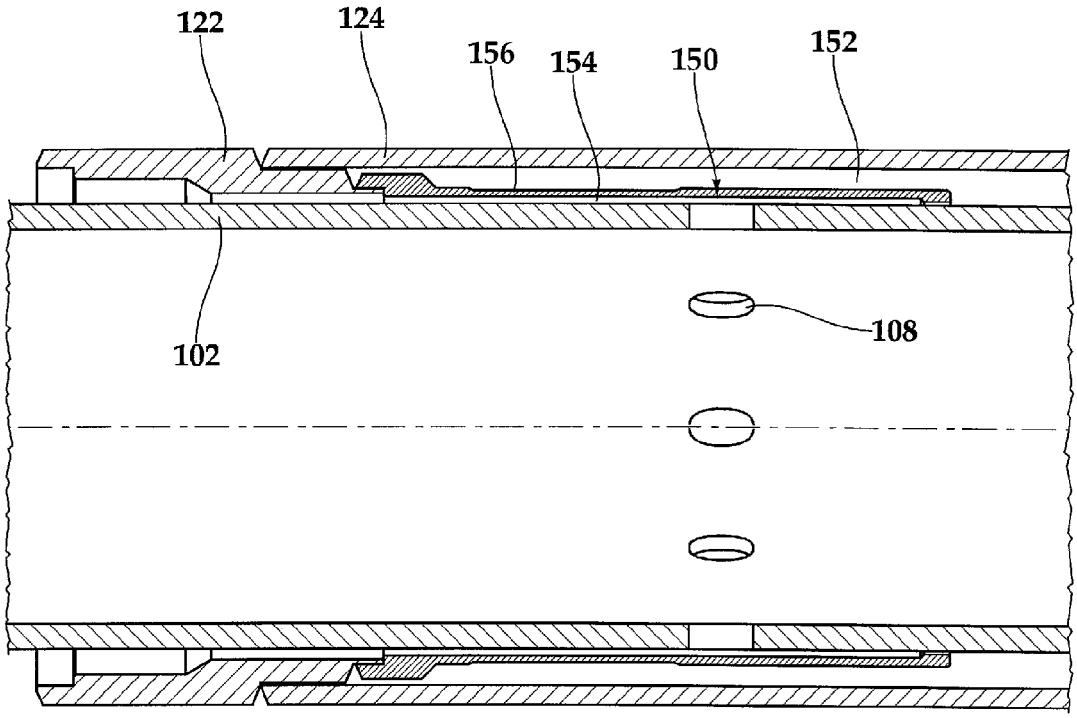
FIGS. 4A-4B are cross sectional views of one embodiment of a closure assembly in its various operating configurations that is operable for use in a flow control screen according to an embodiment of the present invention.

Referring again to FIG. 2C, a closure assembly having a pressure deformable element depicted as a closure sleeve 150 is securably connected to a downhole end of intermediate housing 122 and is positioned in the annular region between closure housing 124 and base pipe 102. More specifically, closure sleeve 150 is positioned around the section of base pipe 102 including production ports 108 but does not extend to the section of base pipe 102 including closure ports 110 which divides the annular region between closure housing 124 and base pipe 102 into a closure chamber 152 to the exterior of closure sleeve 150 and a production path 154 to the interior of closure sleeve 150, as best seen in FIG. 4A and which represents the production configuration of flow control screen 100. Preferably, the downhole end of closure sleeve 150 is securably connected to base pipe 102 by welding or other suitable means. Alternatively, a close fitting, sealing or similar relationship may exist between the downhole end of closure sleeve 150 and base pipe 102 such that a differential pressure may be established between closure chamber 152 and production path 154.

Figure 4B:
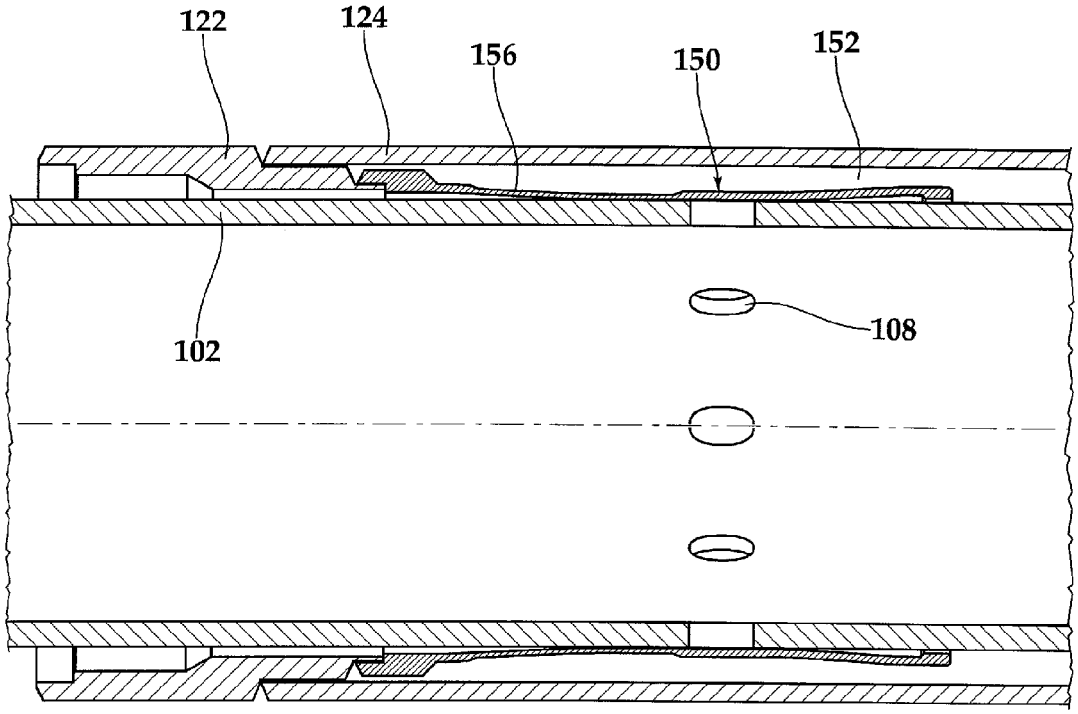

If it is desired to cease production through flow control screen 100, closure sleeve 150 may be operated to its closed configuration. For example, as described above, a straddle assembly (not shown) may be run downhole on a conveyance, such as a coiled tubing, wireline or the like, and positioned adjacent to closure ports 110. The straddle assembly may be used to pressurize closure chamber 152 to a pressure sufficient to radially deform closure sleeve 150 such that it contacts and substantially provides a seal against base pipe 102, thereby closing off production path 154 and placing flow control screen 100 in its shut off configuration, as best seen in FIG. 4B. To facilitate this operation, closure sleeve 150 is preferably formed from a deformable metal, such as stainless steel, that is operable to be plastically deformed in response to a radially imposed pressure differential. In addition, closure sleeve 150 preferably includes a radially reduced section 156 that creates a location of preferential and predictable deformation under a radially imposed pressure differential.

If it is thereafter desired to enable production through flow control screen 100, closure sleeve 150 may be operated back to its open configuration. For example, a straddle assembly may be run downhole on a conveyance and positioned adjacent to closure ports 110. The straddle assembly may be used to reduce the pressure or create a vacuum within closure chamber 152 such that the formation pressure operating on the production path 154 and/or hydrostatic pressure applied through production ports 108 from the interior of flow control screen 100 create a sufficient radial force to radially deform closure sleeve 150 such that it no longer contacts or provides a seal against base pipe 102, thereby opening production path 154 and returning flow control screen 100 in its production configuration, as best seen in FIG. 4A.

Figure 5A:
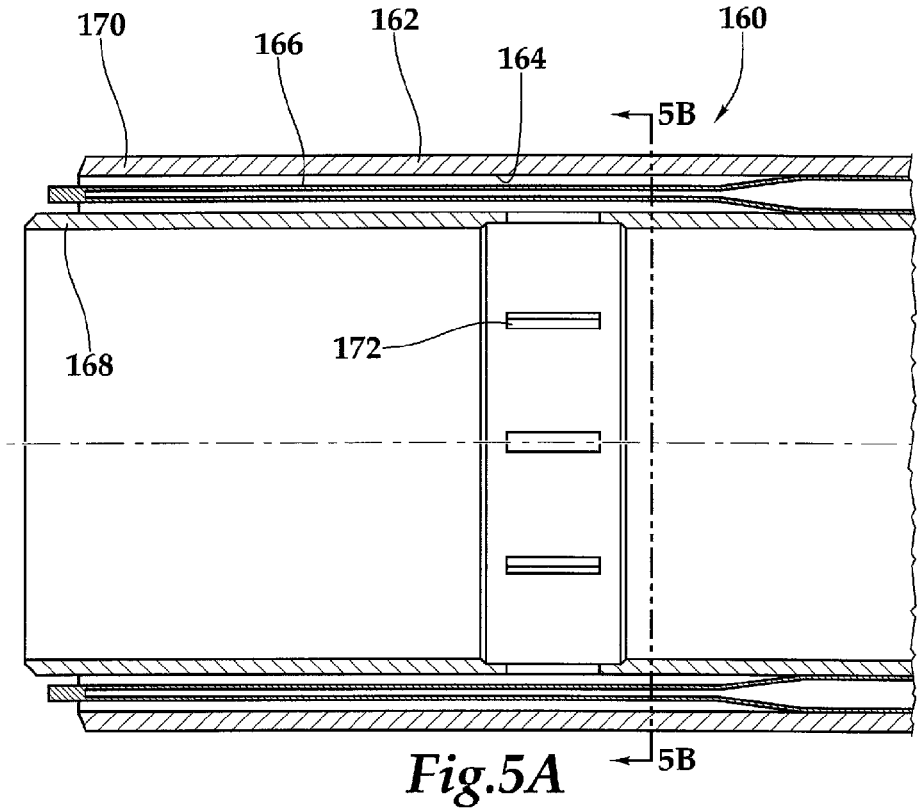
FIGS. 5A-5C are cross sectional views of another embodiment of a closure assembly in its various operating configurations that is operable for use in a flow control screen according to an embodiment of the present invention.
Figure 5C:
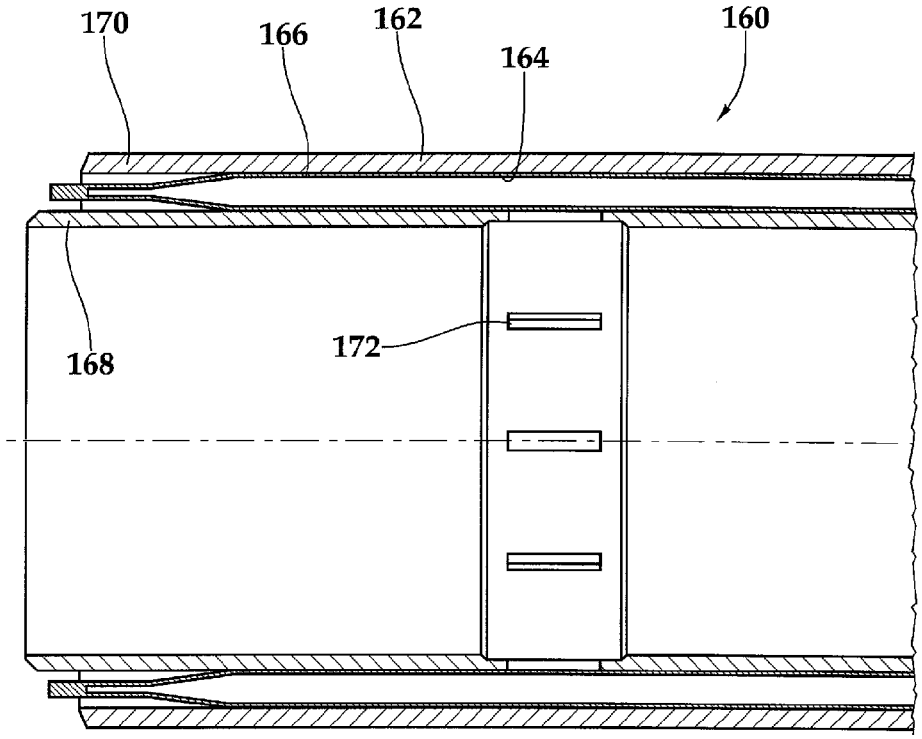
Figure 5B:
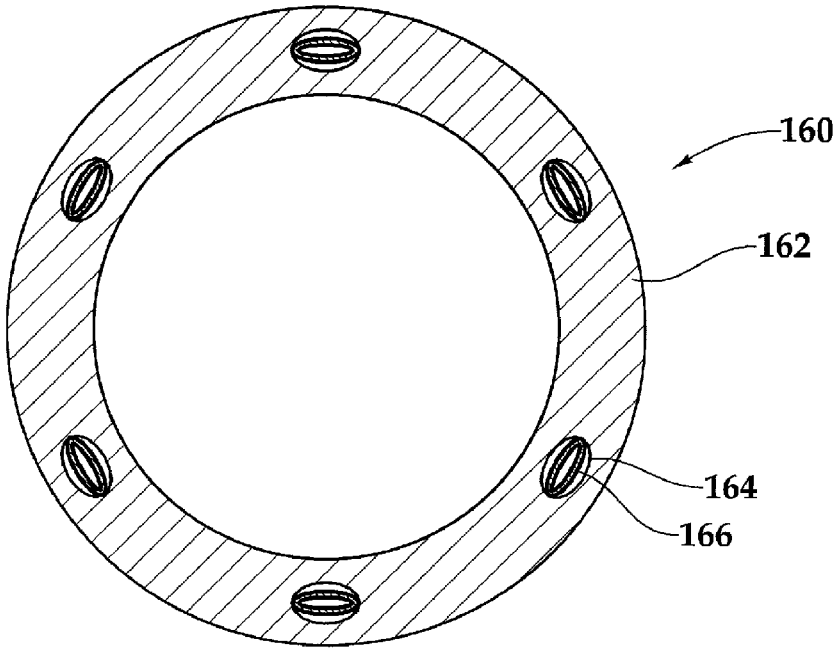

Referring now to FIGS. 5A-5C, therein are depicted various views of an alternate embodiment of a closure assembly that is generally designated 160 and is operable to be positioned around base pipe 102 and replace closure sleeve 150 in flow control screen 100. In the illustrated embodiment, closure assembly 160 is formed from a tubular member 162 having a plurality of axial extending production paths depicted as oval shaped openings 164 extending therethrough, as best seen in FIG. 5B. Positioned within each opening 164 is a pressure deformable element depicted as an expandable tube 166 that is preferably welded or threadably secured therein in a fluid tight matter and preferably has a closed uphole end. Closure assembly 160 is positioned within a flow control screen, such as flow control screen 100, by securably connecting an inner diameter portion 168 of tubular member 162 to the base pipe of flow control screen 100 and securably connecting an outer diameter portion 170 of tubular member 162 within the housing of flow control screen 100 to form a section of the housing. Closure assembly 160 includes a plurality of slots 172 that are generally axially aligned with and provide for fluid communication with production ports 108 of base pipe 102. Each of the slots 172 is circumferentially aligned with one of the openings 164 to establish a production path through closure assembly 160, when closure assembly 160 is in its open configuration, as best seen in FIG. 5A, which corresponds to the production configuration of flow control screen 100.

Referring collectively to FIGS. 2C and 5C, if it is desired to cease production through a flow control screen 100 having a closure assembly 160 installed therein, closure assembly 160 may be operated to its closed configuration. For example, as described above, a straddle assembly may be run downhole on a conveyance and positioned adjacent to closure ports 110. The straddle assembly may be used to pressurize expandable tubes 166 to a pressure sufficient to deform expandable tubes 166 into contact with the inner surface of openings 164 which substantially provides a seal against slots 172, thereby closing off the production path and placing flow control screen 100 in its shut off configuration. To facilitate this operation, expandable tubes 166 are preferably formed from a deformable metal, such as stainless steel, that is operable to be plastically deformed in response to internal pressure.

If it is thereafter desired to enable production through a flow control screen 100 having a closure assembly 160 installed therein, closure assembly 160 may be operated back to its open configuration. For example, a straddle assembly may be run downhole on a conveyance and positioned adjacent to closure ports 110. The straddle assembly may be used to reduce the internal pressure or create a vacuum within expandable tubes 166 such that the formation pressure and/or hydrostatic pressure applied through slots 172 from the interior of flow control screen 100 create a sufficient force to collapse expandable tubes 166 such that they no longer provide a seal against slots 172, thereby returning flow control screen 100 in its production configuration, as best seen in FIG. 5A.

Figure 6B:
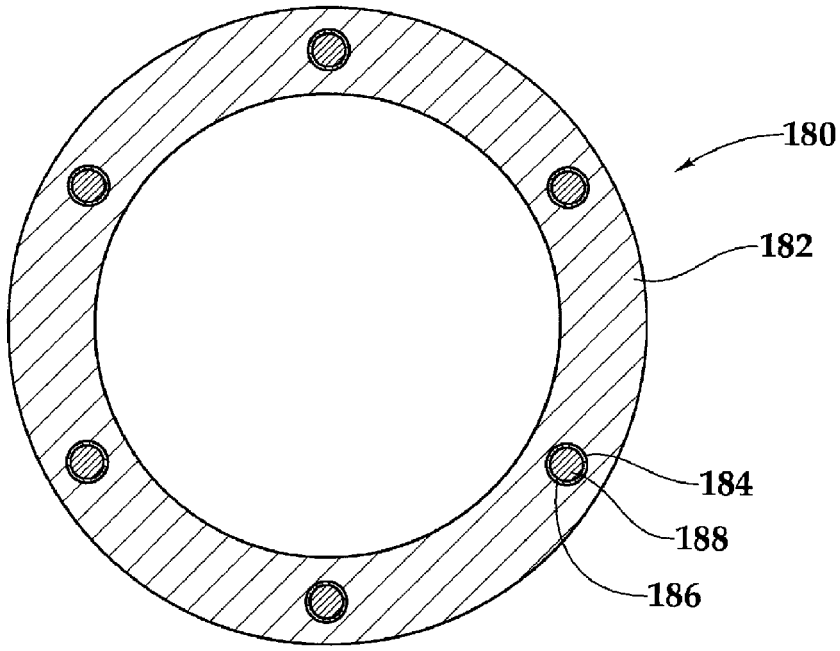
FIGS. 6A-6C are cross sectional views of another embodiment of a closure assembly in its various operating configurations that is operable for use in a flow control screen according to an embodiment of the present invention.
Figure 6A:
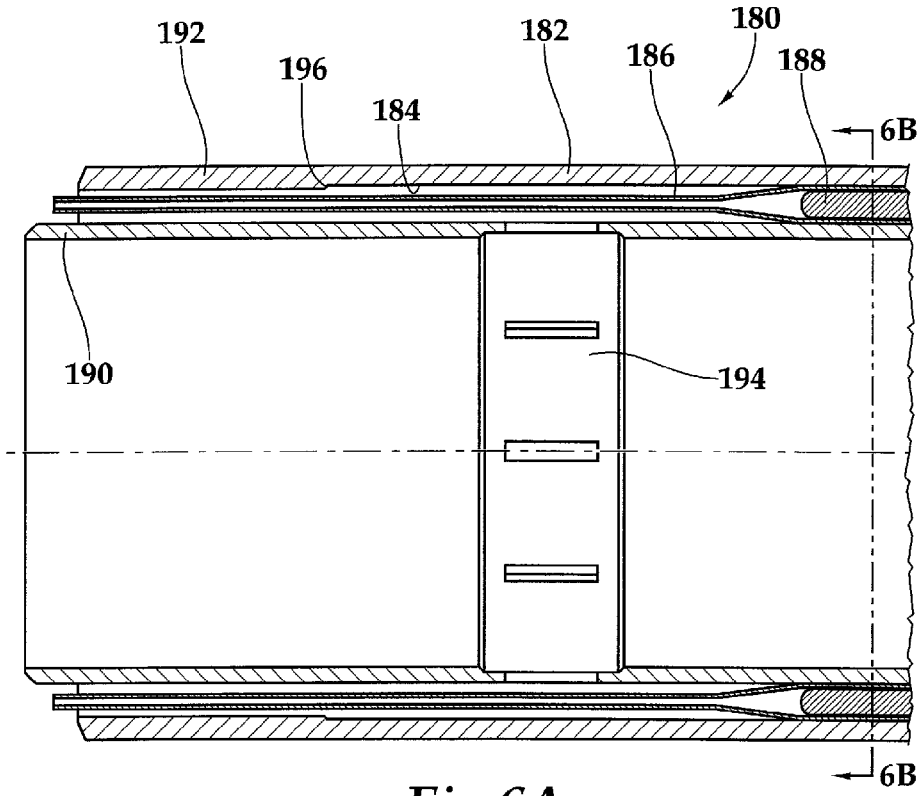
Figure 6C:
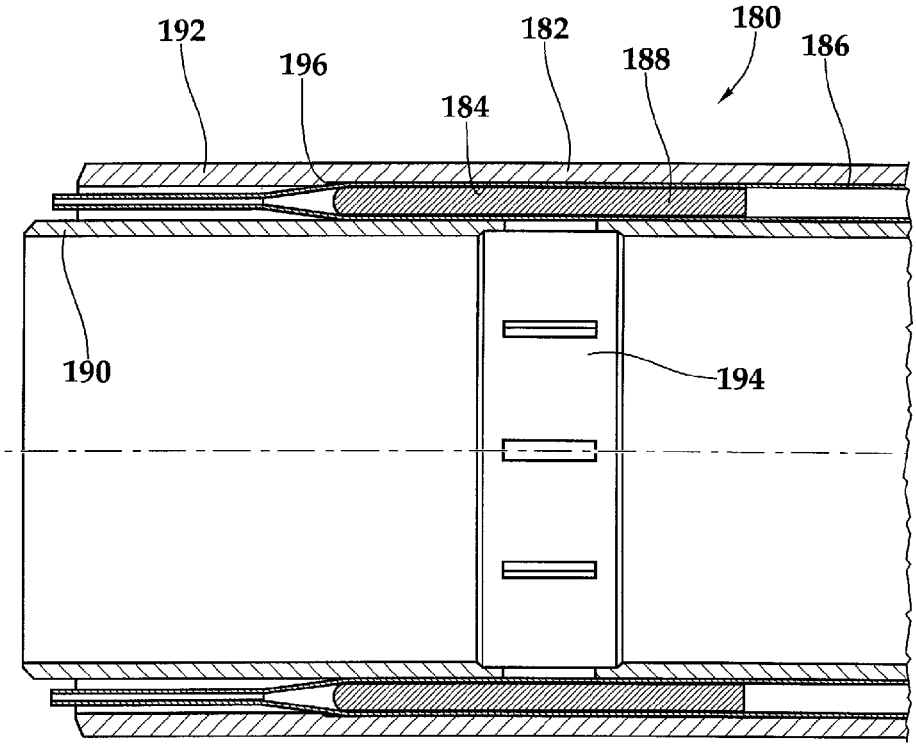

Referring now to FIGS. 6A-6C, therein are depicted various views of an alternate embodiment of a closure assembly that is generally designated 180 and is operable to be positioned around base pipe 102 and replace closure sleeve 150 in flow control screen 100. In the illustrated embodiment, closure assembly 180 is formed from a tubular member 182 having a plurality of axial extending production paths depicted as circular shaped openings 184, as best seen in FIG. 6B. Positioned within each opening 184 is a deformable element depicted as an expandable tube 186 that is preferably welded or threadably secured therein in a fluid tight matter and preferably open at its uphole end. Operably positioned within each expandable tube 186 is a piston 188. Closure assembly 180 is positioned within a flow control screen, such as flow control screen 100, by securably connecting an inner diameter portion 190 of tubular member 182 to base pipe 102 of flow control screen 100 and securably connecting an outer diameter portion 192 of tubular member 182 within the housing of flow control screen 100 to form a section of the housing. Closure assembly 180 includes a plurality of slots 194 that are generally axially aligned with and provide for fluid communication with production ports 108 of base pipe 102. Each of the slots 194 is circumferentially aligned with one of the openings 184 to establish a production path through closure assembly 180, when closure assembly 180 is in its open configuration, as best seen in FIG. 6A, which corresponds to the production configuration of flow control screen 100.

Referring collectively to FIGS. 2C and 6C, if it is desired to cease production through a flow control screen 100 having a closure assembly 180 installed therein, closure assembly 180 may be operated to its closed configuration. For example, as described above, a straddle assembly may be run downhole on a conveyance and positioned adjacent to closure ports 110. The straddle assembly may be used to apply pressure against pistons 188 which shifts pistons 188 uphole within expandable tubes 186, deforming expandable tubes 186 into contact with the inner surface of openings 184 which substantially provides a seal against slots 194, thereby closing off the production path and placing flow control screen 100 in its shut off configuration. Preferably, pistons 188 travel in the uphole direction until they reach a no go shoulder 196 within openings 184, as best seen in FIG. 6C.

If it is thereafter desired to enable production through a flow control screen 100 having a closure assembly 180 installed therein, closure assembly 180 may be operated back to its open configuration. For example, a straddle assembly may be run downhole on a conveyance and positioned adjacent to closure ports 110. The straddle assembly may be used to reduce the internal pressure or draw a vacuum within expandable tubes 186 such that pistons 188 are retracted and the formation pressure and/or hydrostatic pressure applied through slots 194 from the interior of flow control screen 100 create a sufficient force to collapse expandable tubes 186 such that they no longer provide a seal against slots 194, thereby returning flow control screen 100 in its production configuration, as best seen in FIG. 6A.

Figure 7A:
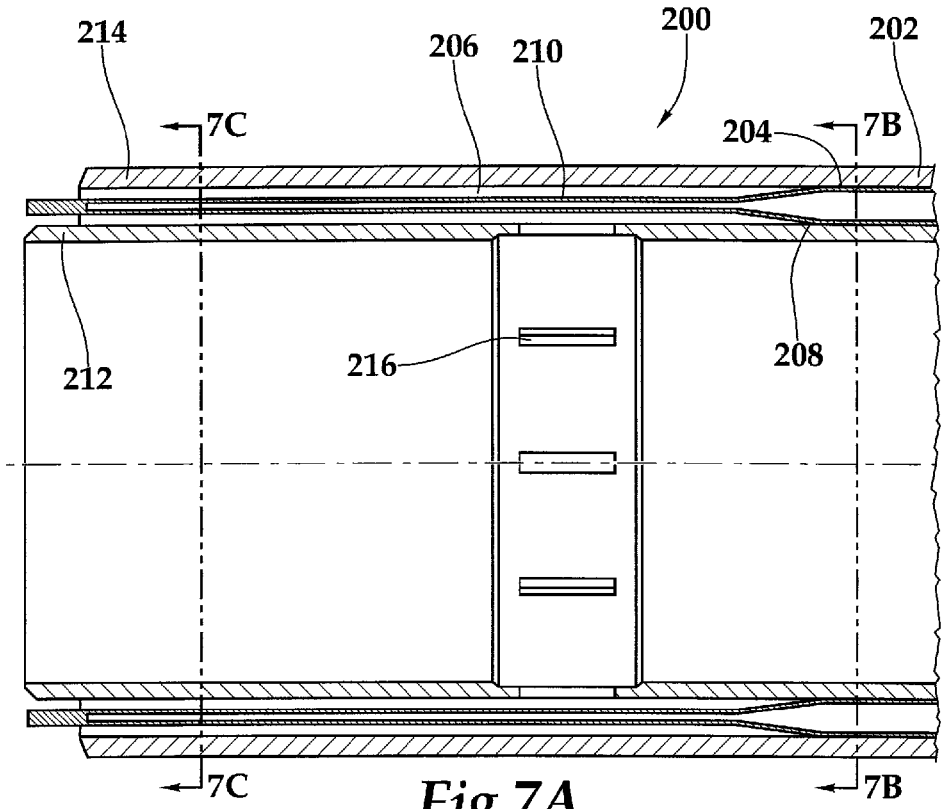
FIGS. 7A-7D are cross sectional views of another embodiment of a closure assembly in its various operating configurations that is operable for use in a flow control screen according to an embodiment of the present invention.
Figure 7D:
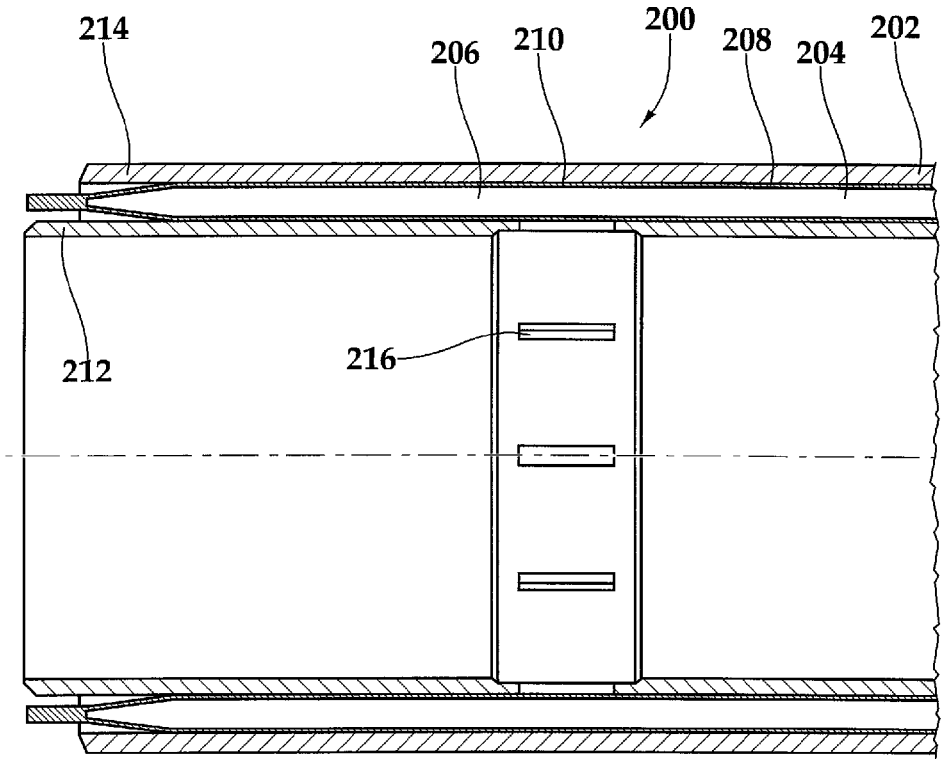
Figure 7B:
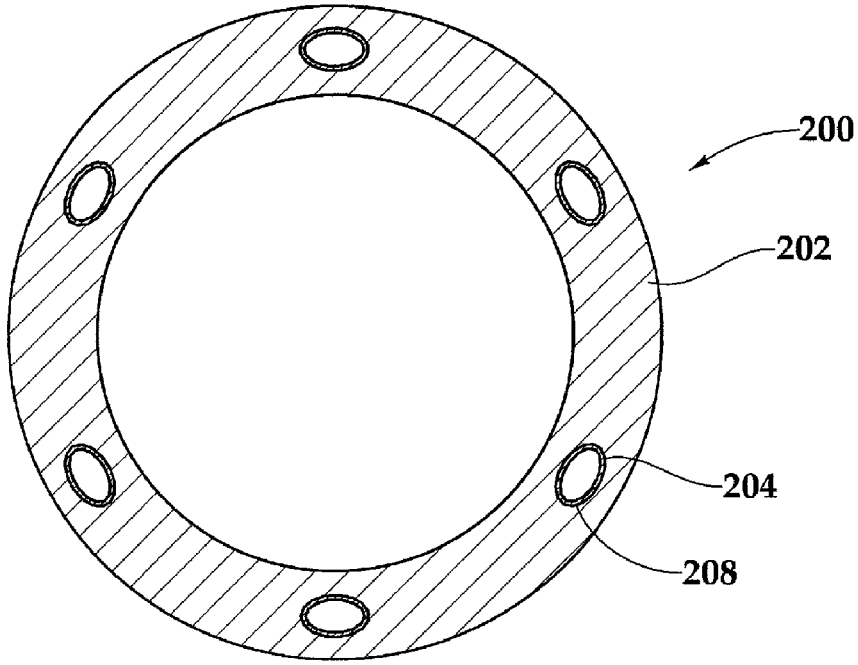
Figure 7C:
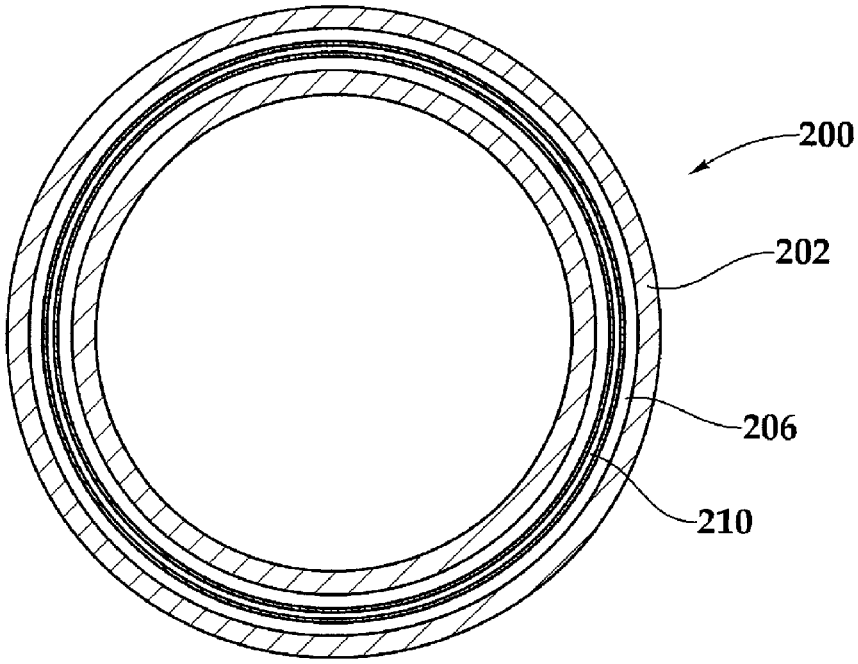

Referring now to FIGS. 7A-7D, therein are depicted various views of an alternate embodiment of a closure assembly that is generally designated 200 and is operable to be positioned around base pipe 102 and replace closure sleeve 150 in flow control screen 100. In the illustrated embodiment, closure assembly 200 is formed from a tubular member 202 having a plurality of axial extending production paths depicted as oval shaped openings 204 in a downhole section, as best seen in FIG. 7B, and as an annular region 206 in an uphole section, as best seen in FIG. 7C. Positioned within each opening 204 is an inlet tube 208 that is preferably welded or threadably secured therein in a fluid tight matter. Positioned within annular region 206 is a pressure deformable element depicted as an expandable annular unit 210 that is in fluid communication with inlet tubes 208 and is preferably closed at its uphole end. Closure assembly 200 is positioned within a flow control screen, such as flow control screen 100, by securably connecting an inner diameter portion 212 of tubular member 202 to the base pipe of flow control screen 100 and securably connecting an outer diameter portion 214 of tubular member 202 within the housing of flow control screen 100 to form a section of the housing. Closure assembly 200 includes a plurality of slots 216 that are generally axially aligned with and provide for fluid communication with production ports 108 of base pipe 102. Each of the slots 216 is in fluid communication with annular region 206 to establish a production path through closure assembly 200, when closure assembly 200 is in its open configuration, as best seen in FIG. 7A, which corresponds to the production configuration of flow control screen 100.

Referring collectively to FIGS. 2C and 7D, if it is desired to cease production through a flow control screen 100 having a closure assembly 200 installed therein, closure assembly 200 may be operated to its closed configuration. For example, as described above, a straddle assembly may be run downhole on a conveyance and positioned adjacent to closure ports 110. The straddle assembly may be used to pressurize expandable annular unit 210 to a pressure sufficient to deform expandable annular unit 210 into contact with the inner surface of annular region 206 which substantially provides a seal against slots 216, thereby closing off the production path and placing flow control screen 100 in its shut off configuration. To facilitate this operation, expandable annular unit 210 is preferably formed from a deformable metal, such as stainless steel, that is operable to be plastically deformed in response to internal pressure.

If it is thereafter desired to enable production through a flow control screen 100 having a closure assembly 200 installed therein, closure assembly 200 may be operated back to its open configuration. For example, a straddle assembly may be run downhole on a conveyance and positioned adjacent to closure ports 110. The straddle assembly may be used to reduce the internal pressure or created a vacuum within expandable annular unit 210 such that the formation pressure and/or hydrostatic pressure applied through slots 216 from the interior of flow control screen 100 create a sufficient force to collapse expandable annular unit 210 such that it no longer provide a seal against slots 216, thereby returning flow control screen 100 in its production configuration, as best seen in FIG. 7A.

Even though closure assembly 200 has been described as having a plurality of inlet tubes 208 positioned with a plurality of openings 204 to provide fluid communication with expandable annular unit 210, it is to be understood by those skilling in the art that fluid communication with expandable annular unit 210 may be established using other configurations including, but not limited to, using a single inlet tube 208 associated with a single opening 204, using no inlet tubes and communicating directly with an annular opening of expandable annular unit 210 wherein the open end of expandable annular unit 210 is preferably welded within annular region 206 in a fluid tight matter or other similar configuration.

While this invention has been described with reference to illustrative embodiments, this description is not intended to be construed in a limiting sense. Various modifications and combinations of the illustrative embodiments as well as other embodiments of the invention, will be apparent to persons skilled in the art upon reference to the description. It is, therefore, intended that the appended claims encompass any such modifications or embodiments.

What is claimed is:

1. A flow control screen comprising:

a base pipe having a blank pipe section and a perforated section including at least one production port and at least one closure port;

a filter medium positioned around a first portion of the blank pipe section of the base pipe;

a housing positioned around a second portion of the blank pipe section and the perforated section of the base pipe; and a deformable element positioned between the housing and a portion of the perforated section including the at least one production port but not including the at least one closure port to define a production path between the at least one production port and the filter medium such that application of a sufficient pressure to the at least one closure port acts on the deformable element to deform the deformable element to substantially close the production path.

2. The flow control screen as recited in claim 1 wherein the deformable element further comprises a pressure deformable element.

3. The flow control screen as recited in claim 1 wherein the deformable element further comprises a closure sleeve.

4. The flow control screen as recited in claim 3 wherein the closure sleeve further comprises an annular closure sleeve.

5. The flow control screen as recited in claim 1 wherein the deformable element further comprises at least one expandable tube.

6. The flow control screen as recited in claim 5 further comprising a moveable piston disposed within the at least one expandable tube to aid in the deformation of the expandable tube in response to the sufficient pressure.

7. The flow control screen as recited in claim 1 wherein the deformable element further comprises a plurality of expandable tubes.

8. The flow control screen as recited in claim 1 wherein the deformable element further comprises an expandable annular unit.

9. The flow control screen as recited in claim 1 wherein the deformable element is operable to reopen the production path in response to a sufficient pressure reduction at the at least one closure port.

10. The flow control screen as recited in claim 1 further comprising at least one valve assembly disposed within a fluid flow path between the at least one production port and the filter medium, the valve assembly including a valve body, a valve plug received within the valve body and a retainer pin initially preventing relative movement between the valve body and the valve plug until pressure of a predetermined threshold level is exceed.

11. A flow control apparatus comprising:

a tubular member including at least one production port and at least one closure port;

a housing positioned around the tubular member; and a deformable element positioned between the housing and a portion of the tubular member including the at least one production port but not including the at least one closure port to define a production path between the deformable element and the base pipe such that application of a sufficient pressure to the at least one closure port acts on the deformable element to deform the deformable element to substantially close the production path.

12. The flow control apparatus as recited in claim 11 wherein the deformable element further comprises a pressure deformable element.

13. The flow control apparatus as recited in claim 11 wherein the deformable element further comprises a closure sleeve.

14. The flow control apparatus as recited in claim 11 wherein the deformable element further comprises at least one expandable tube.

15. The flow control apparatus as recited in claim 14 further comprising a moveable piston disposed within the at least one expandable tube to aid in the deformation of the expandable tube in response to the sufficient pressure.

16. The flow control apparatus as recited in claim 11 wherein the deformable element further comprises an expandable annular unit.

17. The flow control apparatus as recited in claim 11 wherein the deformable element is operable to reopen the production path in response to a sufficient pressure reduction at the at least one closure port.

18. A method for operating a flow control screen comprising:

providing a base pipe having a perforated section including at least one production port and at least one closure port;

providing a housing positioned around the tubular member; and providing a deformable element positioned between the housing and a portion of the perforated section of the base pipe including the at least one production port but not including the at least one closure port to define a production path between the at least one production port and a filter medium; applying a sufficient pressure to the at least one closure port; and responsive to the sufficient pressure, deforming the deformable element to substantially close the production path.

19. The method as recited in claim 18 further comprising, responsive to the sufficient pressure, moving a piston disposed within the deformable element to aid in the deformation of the deformable element.

20. The method as recited in claim 18 further comprising reopening the production path in response to a sufficient pressure reduction at the at least one closure port.

21. The method as recited in claim 18 further comprising:

pressurizing the flow control screen at the at least one production port;

holding the pressure within the flow control screen with a valve assembly disposed within a fluid flow path in the flow control screen;

increasing the pressure in the flow control screen above a predetermined threshold level to shear the retainer pin of the valve assembly causing a shortening of the valve assembly and continuing to hold pressure within the flow control screen;

decreasing the pressure at the at least one production port; and responsive to the pressure decease, discharging the valve assembly from the fluid flow path.

* * * * *